US007191571B2

(12) United States Patent
Schools et al.

(10) Patent No.: US 7,191,571 B2
(45) Date of Patent: Mar. 20, 2007

(54) MODULAR CONSTRUCTION BLOCKS, BUILDING STRUCTURES, KITS, AND METHODS FOR FORMING BUILDING STRUCTURES

(76) Inventors: Jody L. Schools, 208 Schoolhouse Rd., Stuyvesant, NY (US) 12173; Jon L. Schools, 182 Fowler Lake Rd., Ghent, NY (US) 12075

( * ) Notice: Subject to any disclaimer, the term of this patent is extended or adjusted under 35 U.S.C. 154(b) by 76 days.

(21) Appl. No.: 10/180,877

(22) Filed: Jun. 26, 2002

(65) Prior Publication Data

US 2004/0000114 A1 Jan. 1, 2004

(51) Int. Cl.
*E04C 2/26* (2006.01)

(52) U.S. Cl. ..... 52/607; 52/439; 52/505; 52/747.14

(58) Field of Classification Search ..... 52/503–505, 52/605–608, 747.12, 410, 439, 426, 436, 52/309.4, 404.1, 293.2, 742.14; 446/125, 446/128; 404/29, 36
See application file for complete search history.

(56) References Cited

U.S. PATENT DOCUMENTS

| | | | | | |
|---|---|---|---|---|---|
| 786,884 | A | | 4/1905 | Faulkner | |
| 861,348 | A | | 7/1907 | Baltz | |
| 1,242,087 | A | | 10/1917 | Waddell | |
| 1,524,146 | A | * | 1/1925 | Murray | 52/302.4 |
| 1,907,170 | A | * | 5/1933 | A' Hearn | 165/9.1 |
| 1,968,034 | A | * | 7/1934 | Ferguson | 52/323 |
| 2,019,133 | A | | 10/1935 | Hincke | 72/40 |
| 2,184,714 | A | * | 12/1939 | Freeman | 52/250 |
| 3,165,750 | A | * | 1/1965 | Tell | 52/568 |
| 3,374,917 | A | | 3/1968 | Troy | 220/23.4 |
| 3,391,507 | A | * | 7/1968 | Downing | 52/314 |
| 3,782,049 | A | * | 1/1974 | Sachs | 52/309.9 |
| 3,878,658 | A | * | 4/1975 | Davis et al. | 52/410 |
| 3,905,071 | A | * | 9/1975 | Brumlik | 24/706.4 |
| 4,057,946 | A | | 11/1977 | Barrett | 52/436 |
| 4,227,829 | A | * | 10/1980 | Landry, Jr. | 405/20 |
| 4,481,155 | A | | 11/1984 | Frohwerk | 261/94 |
| 4,492,064 | A | * | 1/1985 | Bynoe | 52/309.8 |
| 4,590,729 | A | | 5/1986 | Hegazi | 52/437 |
| 4,602,908 | A | * | 7/1986 | Kroeber | 446/128 |
| 4,719,738 | A | * | 1/1988 | Lee | 52/607 |
| 4,758,195 | A | * | 7/1988 | Walsh | 446/85 |
| 4,860,515 | A | * | 8/1989 | Browning, Jr. | 52/426 |
| 4,924,641 | A | | 5/1990 | Gibbar, Jr. | 52/204 |
| 5,003,746 | A | * | 4/1991 | Wilston | 52/592.1 |

(Continued)

FOREIGN PATENT DOCUMENTS

| | | | |
|---|---|---|---|
| EP | 0007630 | * | 1/1980 |

(Continued)

*Primary Examiner*—Winnie Yip
(74) *Attorney, Agent, or Firm*—Heslin Rothenberg Farley & Mesiti P.C.

(57) ABSTRACT

The modular construction blocks include a preform having a plurality of passageways therethrough. The preforms may by formed from a plastic material and filled with concrete and steel reinforcing bars to form footings, foundations, girders, walls, and roofs. The modular construction blocks generally include a 5-hole block which has five holes or passageways extending therethrough and a 2-hole block which has two holes or passageways extending therethrough. The 5-hole blocks include the plurality of passageways intersecting and extending along three different planes. Kits, building structures, furring strips, and methods for forming building structures are also disclosed.

43 Claims, 9 Drawing Sheets

U.S. PATENT DOCUMENTS 5,351,455 A * 10/1994 Schoonover et al. ..... 52/410
5,415,511 A * 5/1995 Damron ..... 411/480
5,457,926 A 10/1995 Jensen ..... 52/604
5,557,898 A * 9/1996 Dixon ..... 52/410
5,678,378 A * 10/1997 Ellison, Jr. ..... 52/692
5,702,208 A * 12/1997 Hilfiker et al. ..... 405/302.4
5,715,635 A 2/1998 Sherwood ..... 52/286
5,839,243 A * 11/1998 Martin ..... 52/439
5,987,840 A * 11/1999 Leppert ..... 52/592.6
6,161,357 A 12/2000 Altemus ..... 52/592.6
6,253,523 B1 * 7/2001 McKinnon ..... 52/700

FOREIGN PATENT DOCUMENTS

FR 2607857 * 7/1988

* cited by examiner

MODULAR CONSTRUCTION BLOCKS, BUILDING STRUCTURES, KITS, AND METHODS FOR FORMING BUILDING STRUCTURES

FIELD OF THE INVENTION

This invention relates generally to bricks and building structures, and more particularly to modular construction blocks, building structures, kits, and methods for forming building structures.

BACKGROUND OF THE INVENTION

Conventionally, bricks and blocks for constructing building structures include solid bricks made of clay and blocks made of concrete or cement having two chambers in the interior of the blocks.

U.S. Pat. No. 6,161,357 issued to Altemus discloses forming a wall with bricks formed of clay or similar materials and having two or three cylindrical passageways running from top to bottom, and a cylindrical passageway running from one end to the opposite end. The passageways are disposed in two different planes and intersect. Also, the bricks are interlocking and may be filled with concrete and reinforced with rods or posts.

U.S. Pat. No. 5,457,926 issued to Jensen discloses a lightweight, non-cementitious, resilient, interlocking, plastic foam block which can be assembled with other like blocks to produce a light impervious wall. The foam block includes two vertically-extending passageways. The blocks can each be secured to abutting blocks with adhesive. Concrete and re-bar can extend through hollows in the blocks in conventional fashion.

There is a need for still further modular construction blocks, building structures, kits, and method for forming building structures.

SUMMARY OF THE INVENTION

The present invention provides, in a first aspect, a modular construction block which includes a preform having a top surface, a bottom surface, opposite side surfaces, and opposite end surfaces. The preform includes a first horizontal passageway extending between the opposite end surfaces, a pair of spaced-apart vertical passageways extending from the top surface and intersecting the first horizontal passageway, and a pair of spaced-apart second horizontal passageways extending between the opposite side surfaces and intersecting the first horizontal passageway and the pair of vertical passageways.

The present invention provides, in a second aspect, a modular construction block which includes a preform having a top, a bottom, opposite sides, and opposite ends, at least three intersecting passageways extending through the preform. The at least three intersecting passageways extend along three different planes.

The present invention provides, in a third aspect, a method for forming a floor which includes providing a first plurality of modular construction blocks, as described above, and a second plurality of modular construction blocks. The second plurality of modular construction blocks includes a preform having a top surface, a bottom surface, opposite side surfaces, opposite end surfaces, and a pair of spaced-apart horizontal passageways extending between the opposite side surfaces. At least one row of the first plurality of modular construction blocks is assembled in the second plurality of assembled modular construction blocks to define a girder. Thereafter, concrete is introduced into the passageways in the first and second plurality of modular construction blocks.

The present invention provides, in a fourth aspect, a method for forming a footing and a foundation. The method includes assembling a first plurality of modular construction blocks, as described above, end to end to form a perimeter of the foundation, and assembling a second plurality of modular construction blocks in the footing to form the foundation. The second plurality of modular construction blocks includes a preform having a top surface, a bottom surface, opposite side surfaces, and opposite end surfaces, and a pair of spaced-apart horizontal passageways extending between the opposite side surfaces. Concrete is then introduced into the passageways in the first and second plurality of modular construction blocks so that the concrete in the perimeter forms a grid pattern.

The present invention provides, in a fifth aspect, a method for forming a floor which includes assembling a plurality of modular construction blocks comprising a preform having a top surface, a bottom surface, opposite side surfaces, and opposite end surfaces. The preform includes a pair of spaced-apart horizontal passageways extending between the opposite side surfaces. Some of the passageways are opened to the top to form a trough. Thereafter, concrete is introduced into the passageways and troughs of the assembled plurality of modular construction blocks.

The present invention provides, in a sixth aspect, a furring strip for use with modular construction blocks having passageways which are assembled and filled with concrete. The furring strip includes an elongated member and a plurality of elongated anchors attachable to the elongated member. The elongated members have a plurality of outwardly-extending portions for engaging the modular construction block and for extending into the passageways.

The present invention provides, in a seventh aspect, a method for forming a wall which includes assembling a plurality of modular construction blocks comprising a preform having a top surface, a bottom surface, opposite side surfaces, opposite end surfaces, and a pair of spaced-apart vertical passageways extending between the top and bottom surfaces. A plurality of furring strips are installed against the assembled blocks. The plurality of furring strips comprise an elongated member and a plurality of elongated anchors attachable to the elongated member. The elongated member has a plurality of outwardly-extending portions for engaging the modular construction block and extending into the passageways. Thereafter, concrete is introduced into the passageways of the assembled plurality of modular construction blocks so a portion of the plurality of anchors is secured in the concrete.

Also, disclosed are kits comprising the various blocks and furring strips.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

DETAILED DESCRIPTION OF THE INVENTION

FIGS. 1, 3, 8, and 11 illustrate modular construction blocks in accordance with the present invention. As illustrated in FIGS. 1, 3, 8, and 11, the blocks include a preform and a plurality of passageways therethrough. The preforms may by formed from a plastic material and used by assembling and filling with concrete and steel reinforcing bars to form footings, foundations, girders, walls, and roofs. The modular construction blocks generally include a 5-hole block (and modified 5-hole block) which includes five holes or passageways extending therethrough and a 2-hole block (and modified 2-hole block) which includes two holes or passageways extending therethrough. As described in greater detail below, the combination of 5-hole blocks and 2-hole blocks results in forming reinforced cement or concrete within the blocks which has an interlocking grid configuration in one plane or axis, two planes or axes (e.g., wall and floor), and/or three planes or axes (e.g., floor, wall, and roof which strengthens the building structure.

Figure 1:
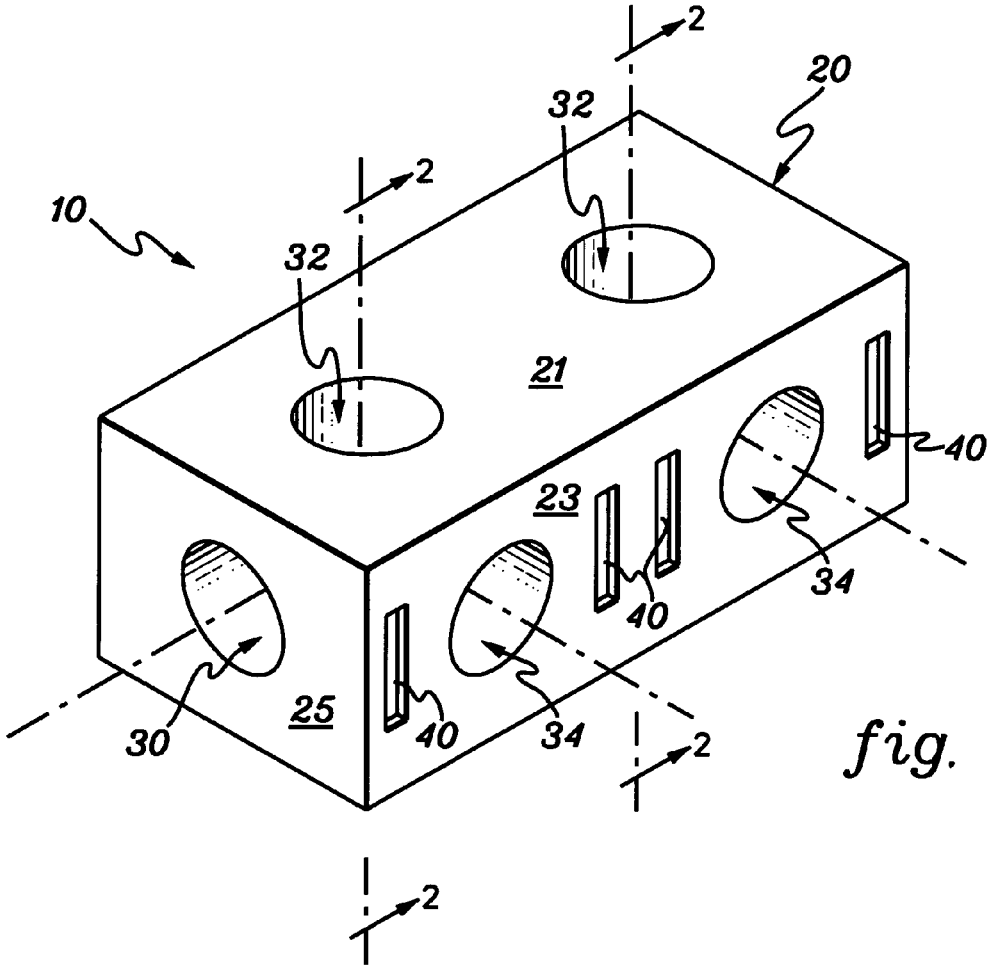
FIG. 1 is a perspective view of a first modular construction block in accordance with the present invention.
Figure 2:
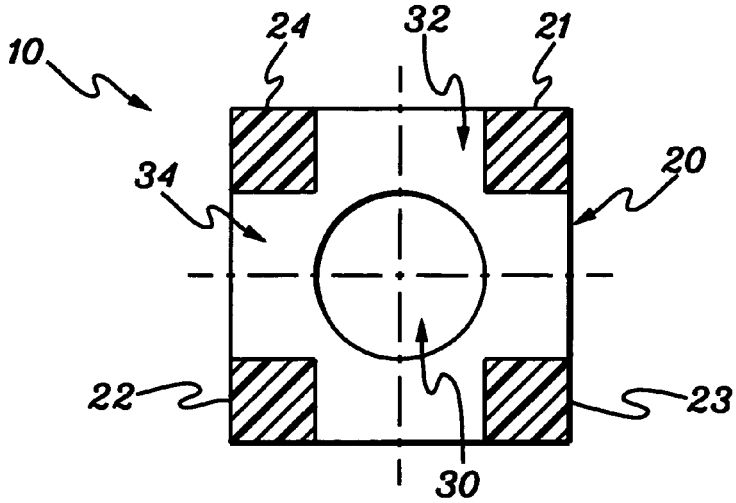
FIG. 2 is an enlarged sectional view of the first modular construction block taken along each of lines 2—2 in FIG. 1.

With reference to FIGS. 1 and 2, a 5-hole modular construction block 10 generally includes a preform 20 having a top surface 21, a bottom surface 22 (FIG. 2), opposite side surfaces 23 and 24 (FIG. 2), and opposite end surfaces 25 (only one end surface being shown in FIG. 1).

A plurality of passageways extends through the preform. For example, the plurality of passageways intersects and extends along three different planes. As illustrated in FIGS. 1 and 2, a first horizontally-extending passageway 30 extends between and opens onto each of the opposite end surfaces. A pair of spaced-apart vertically-extending passageways 32 extends between and opens onto top surface 21 and bottom surface 22 (FIG. 2) and intersects first horizontally-extending passageway 30. A pair of spaced-apart second horizontally-extending passageways 34 extends between and opens onto the opposite side surfaces 23 and 24 and intersects first horizontally-extending passageway 30 and the pair of vertically-extending passageways 32.

Figure 3:
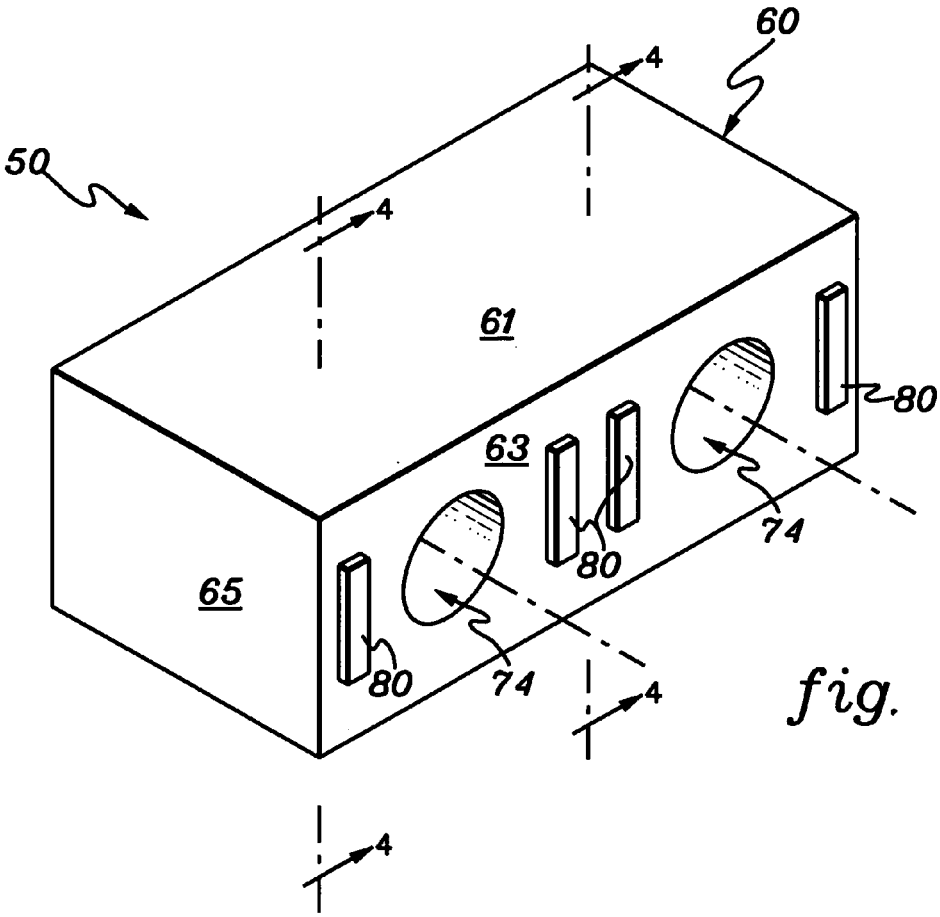
FIG. 3 is a perspective view of a second modular construction block in accordance with the present invention.
Figure 4:
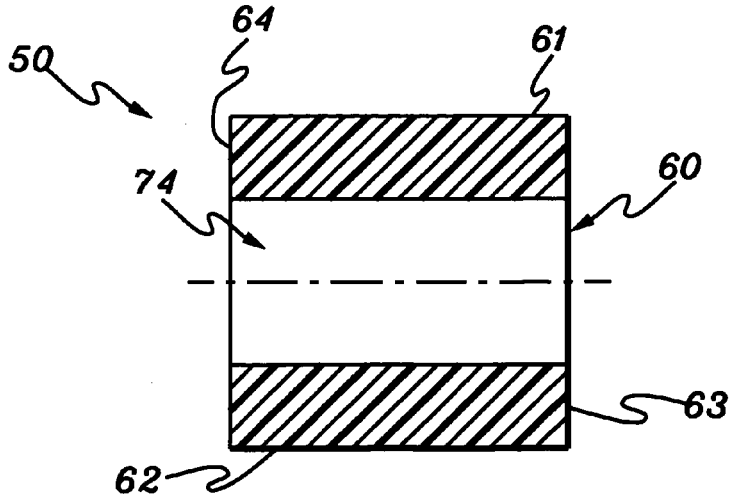
FIG. 4 is an enlarged sectional view of the second modular construction block taken along each of lines 4—4 in FIG. 3.

With reference to FIGS. 3 and 4, a 2-hole modular construction block 50 generally includes a preform 60 having a top surface 61, a bottom surface 62 (FIG. 4), opposite side surfaces 63 and 64 (FIG. 4), and opposite end surfaces 65 (only one end surface shown in FIG. 3). As illustrated in FIGS. 3 and 4, a pair of spaced-apart second horizontally-extending passageways 74 extends between and opens onto the opposite side surfaces 63 and 64 (FIG. 4).

The blocks may also be provided with interlocking portions to aid in aligning and maintaining the blocks in position when assembled or stacked together. For example, the top surface and the bottom surface, the opposite side surfaces, and the opposite end surfaces may each include interlocking portions. FIGS. 1 and 3 illustrate one example of interlocking portions which includes indentations 40 disposed on side surface 23 of block 10 (and side surface 24 may include corresponding raised projections, not shown in FIG. 1). FIG. 3 illustrates an example of raised projections 80 disposed on surface 63 of block 50. It will be appreciated that the opposite surfaces, top surfaces, bottom surfaces, and end surfaces may also be provided with interlocking portions. When the blocks are assembled and/or stacked together, the ends of adjacent blocks may be staggered.

With reference still to FIGS. 1 and 3, the indentations and projections provide alignment in two directions or planes, e.g., up and down, and side-to-side. It will be appreciated that the raised portions and indentations may include other configurations such as raised and indented squares or circles. In addition, the raised portion and indentations may extend completely along the length or width of the block or around the openings. Other suitable interlocking portions for use with the blocks of the present invention are disclosed in U.S. Pat. No. 6,161,357 issued to Altemus, and U.S. Pat. No. 5,457,926 issued to Jensen. The entire subject matter of these patents is incorporated herein by reference.

Figure 5:
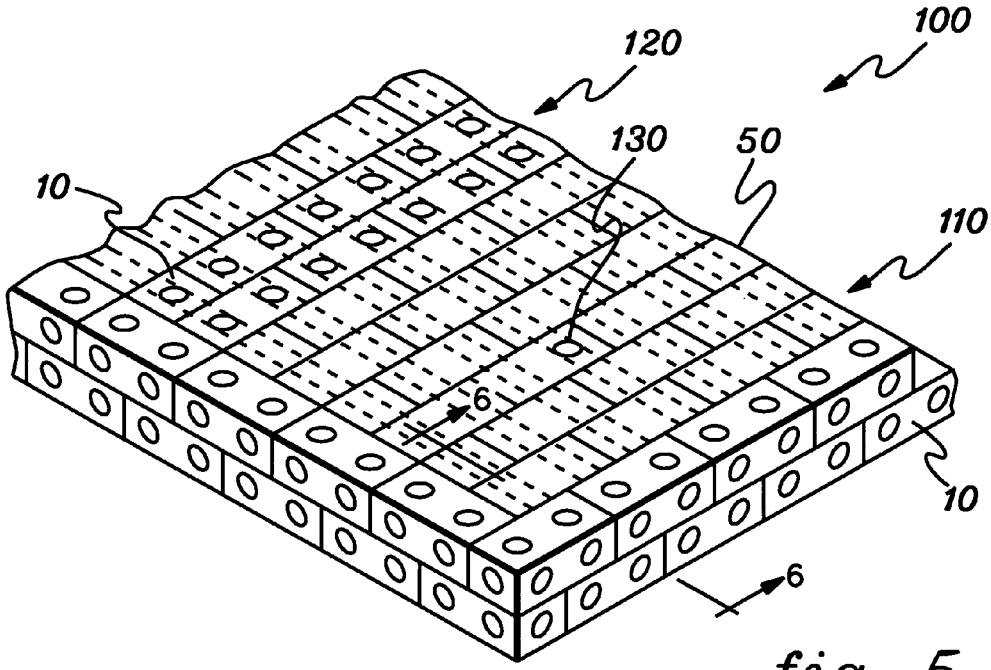
FIG. 5 is a perspective view of a footing, foundation, and girder formed using the modular construction blocks shown in FIGS. 1 and 3.
Figure 6:
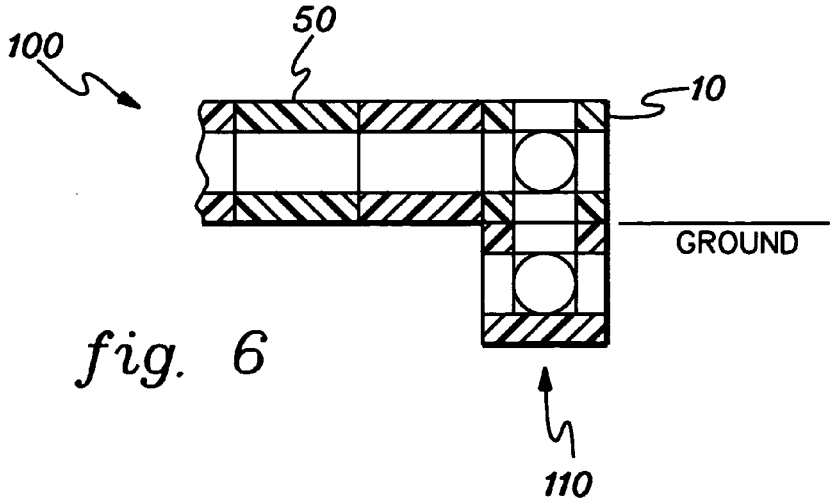
FIG. 6 is a sectional view of the footing and foundation of FIG. 5 taken along line 6—6 in FIG. 5.

FIGS. 5 and 6 illustrate a foundation 100 constructed using a plurality of blocks 10 and 50. A footing 110 of foundation 100 is constructed by stacking two rows of 5-hole blocks 10 in a standard run to form the perimeter of the foundation and laying a plurality of 2-hole blocks 50 within the perimeter. At intervals in the floor, two rows of 5-hole blocks 10 may be installed to form a girder 120 (FIG. 5). The blocks may be initially assembled and held together using an adhesive such as 3M's SUPER 77 adhesive.

Figure 7:
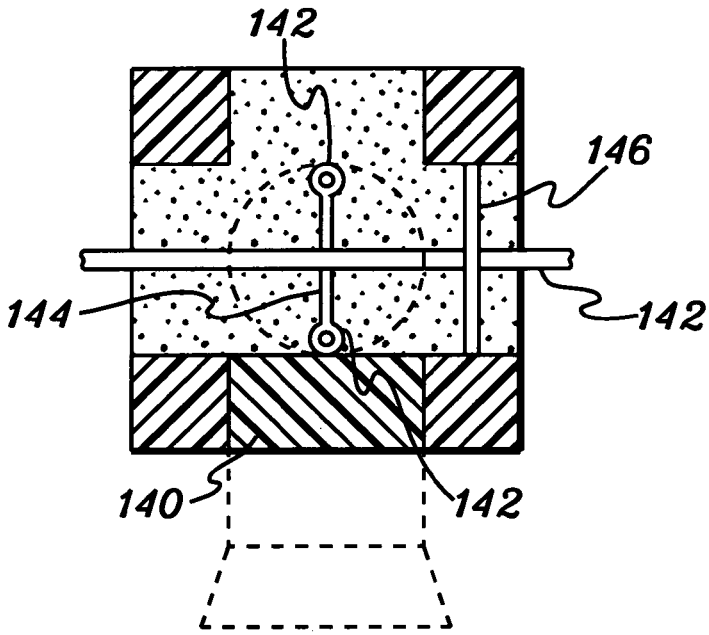
FIG. 7 is a sectional view of the first modular construction block of FIG. 1 along with a plug in accordance with the present invention.

With reference to FIG. 7, plugs 140 (only one of which is shown in FIG. 7) may have a slight taper and used to seal the bottom vertical opening in the blocks. The plugs may also be held and fastened to the block using an adhesive. The top openings which will be filled with concrete provide a solid structure for attachment or securing fasteners.

Steel reinforcement, for example, steel reinforcing bars 142 may be inserted into the blocks forming the foundation. Suitable spacer clips 144 and 146 may be used to support and maintain the steel reinforcing bars in the proper location within the blocks when introducing the concrete. As shown FIG. 7, spacer clips 144 and 146 may be a wire or plastic form having one or portions which engage one or more reinforcing rods. The ends of the clips may be sized to engage the inner surface of the passageways.

Figure 8:
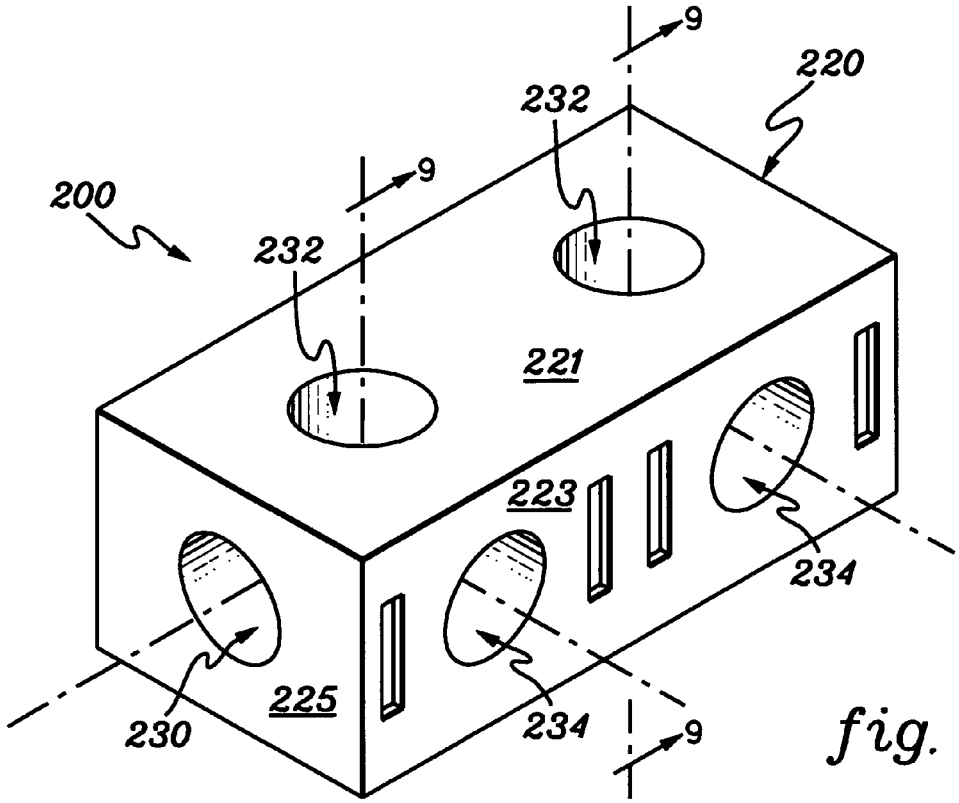
FIG. 8 is a perspective view of a third modular construction block in accordance with the present invention.
Figure 9:
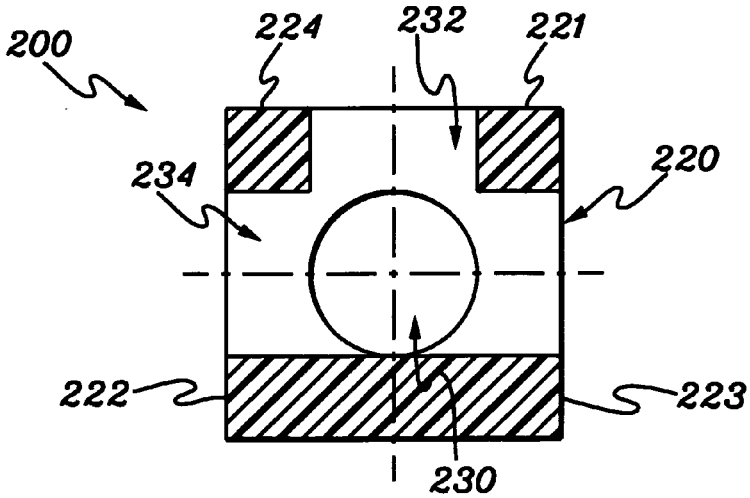
FIG. 9 is an enlarged sectional view of the third modular construction block taken along each of lines 9—9 in FIG. 8.

FIGS. 8 and 9 illustrate a modified 5-hole modular construction block 200. Block 200 may be used for footing, headers, and girders, and avoid the need for attaching plugs to the bottom openings. Block 200 generally includes a preform 220 having a top surface 221, a bottom surface 222 (FIG. 9), opposite side surfaces 223 and 224 (FIG. 9), and opposite end surfaces 225 (only one end surface shown in FIG. 8).

A plurality of passageways extends through the preform. For example, the plurality of passageways intersects and extends along three different planes. As illustrated in FIGS. 8 and 9, a first horizontally-extending passageway 230 extends between and opens onto each of the opposite end surfaces. A pair of spaced-apart vertically-extending passageways 232 extends between top surface 221 and opens into first horizontally-extending passageway 230 and do not extend onto bottom surface 222 as shown in FIG. 9. A pair of spaced-apart second horizontally-extending passageways 234 extends between and opens onto the opposite side surfaces 223 and 224 and intersects first horizontally-extending passageway 230 and the pair of vertically-extending passageways 232.

Blocks 10, 50, and 200 may be formed from plastic or polymeric material such as a foam plastic material. Such foam plastic materials may include dense polystyrene foam. The blocks may also include recycled materials, or combinations of virgin and recycled materials. It is also appreciated that the preforms may be formed from concrete, or cement or clay and used in forming hollow building structures or filled with cement and reinforcing bars.

The blocks may include the top surface, the bottom surface, and the opposite side surfaces defining a square cross-section, and the top surface, the bottom surface, and the opposite end surfaces may define a rectangular cross-section. For example, the blocks may be 24 inches long, 12 inches high, 12 inches wide, and the passageways may be cylindrical having a diameter of 6 inches. It will be appreciated that the blocks may be formed in other sizes and the passageways may have other configurations other than cylindrical. While the blocks have been described as having a top surface and bottom surface, it will also be appreciated that depending on the orientation of the block, the opposite side surfaces may be the top and bottom surfaces.

With reference again to FIG. 5, once the blocks are assembled and the reinforcing bars installed, holes 130 (only one of which is shown in FIG. 5) are cut in the center of the floor. Concrete may then be injected, using a tapered hose end which fits tightly in the hole. Alternatively, the concrete may be injected through the vertical openings in girder 120. The concrete may be a lightweight concrete and may incorporate recycled materials to increase strength and/or reduce weight. The concrete may be driven by a commercial concrete pump which supplies sufficient pressure to cause the concrete to flow through the passageways. When concrete is visible in the blocks forming the footing, the hose is removed, and the hole is sealed with a plug. Thereafter, the blocks forming the footing are filled with concrete.

Figure 10:
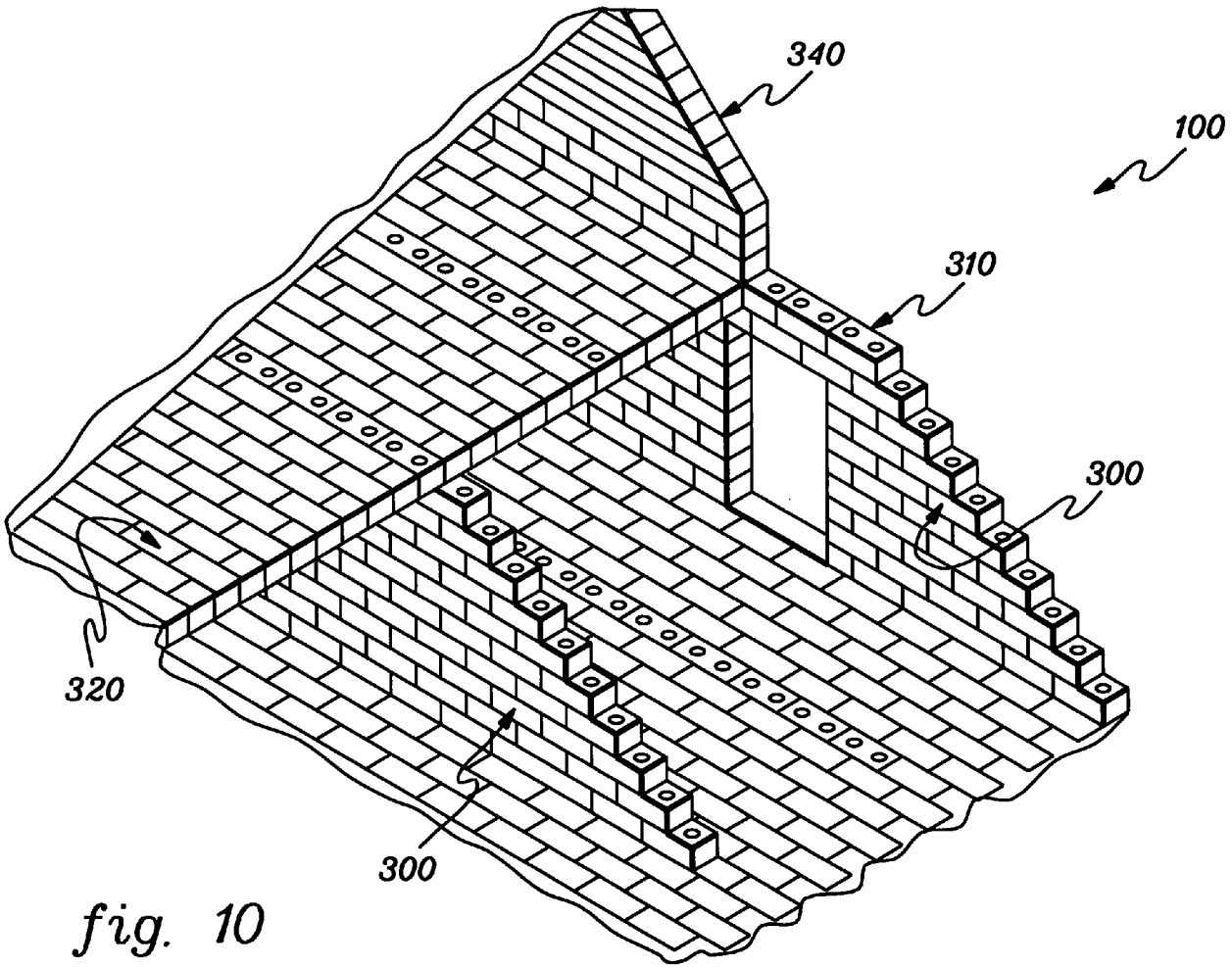
FIG. 10 is a perspective view of a construction of a building in accordance with the present invention using the blocks of FIGS. 1, 3, and 9.

FIG. 10 illustrates a wall 300 formed by stacking 2-hole blocks on the footing with the passageways therein disposed vertically. As discussed above, an adhesive may be used to hold the blocks in place. Doors headers (not shown) and window headers 310 (only one being shown in FIG. 10) are formed by stacking 2-hole blocks from the footing to the top of the desired window or door opening. Two rows of the 5-hole blocks, the lowermost vertical openings being plugged or the lower row of blocks being the modified 5-hole blocks, are then stacked to bridge the openings. Steal reinforcing bars may be inserted in the blocks. Thereafter, concrete can be injected into the passageways. Air vent holes may be required to allow the release of air when injecting the concrete into the walls.

Subsequent floors 320, as well as roofs 340, may require scaffolding in order to install and support the blocks when introducing the concrete as described above. Forming of roofs may also require cutting air vent holes prior to injecting the concrete into the blocks forming the roof.

Where the wall and roof intersect, both the top block of the wall and the lower blocks of the roof may be cut on an angle (e.g., ½ the pitch of the roof) to intersect so that the openings of the passageways align and through which the reinforcing bar and concrete can be introduced. Such a configuration forms a continuous joint along the intersection of the wall and roof.

Figure 11:
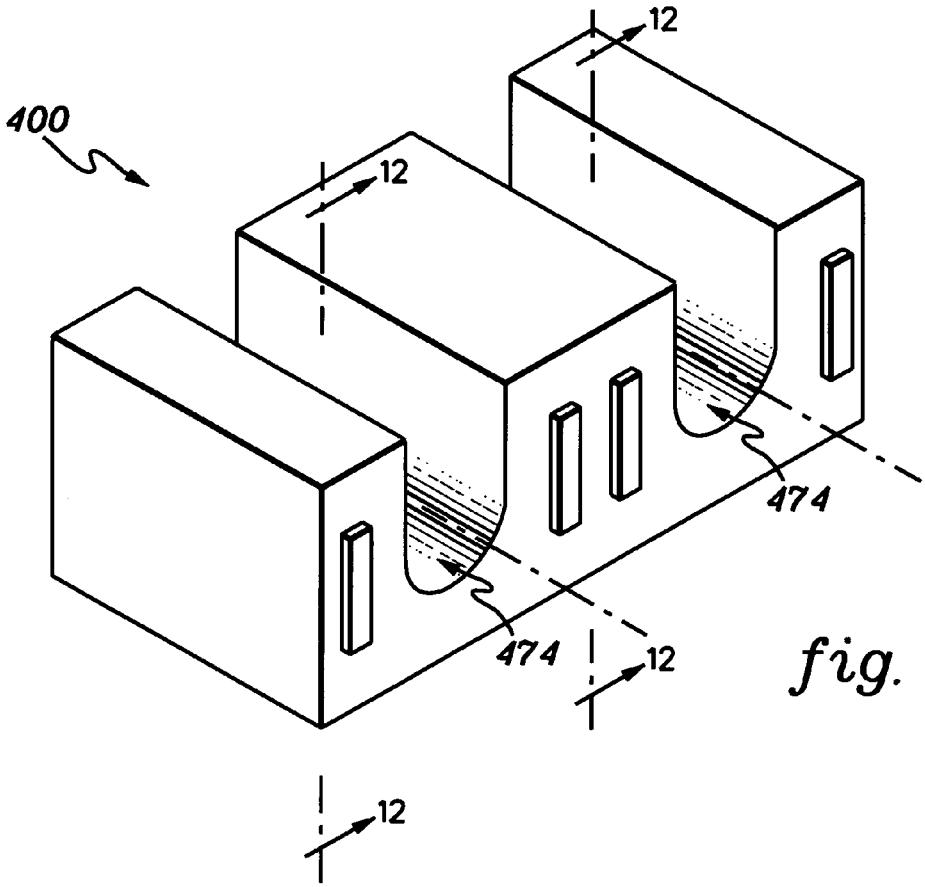
FIG. 11 is a perspective view of a fourth modular construction block in accordance with the present invention.
Figure 12:
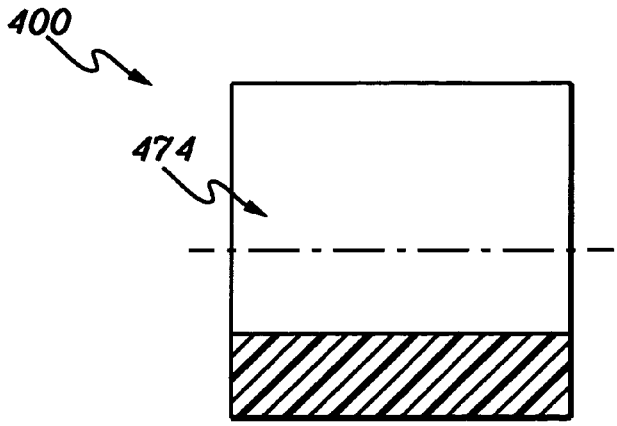
FIG. 12 is a sectional view of the fourth modular construction block taken along each of lines 12—12 in FIG. 11.
Figure 13:
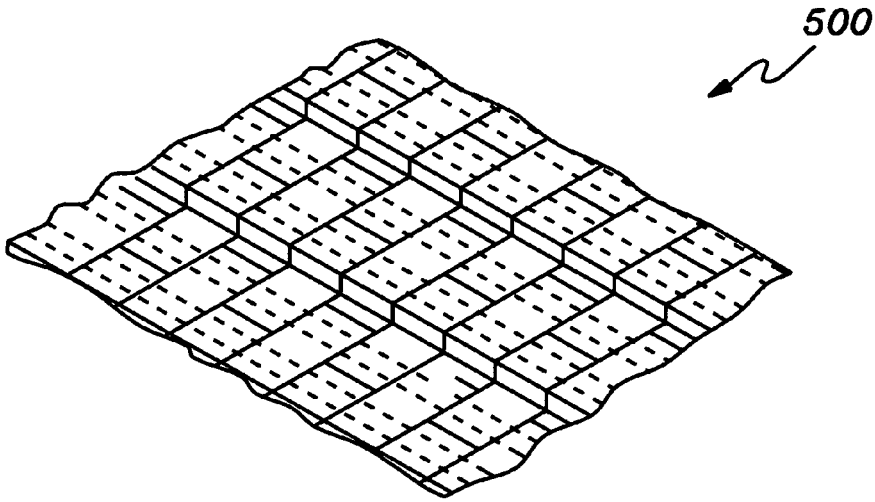
FIG. 13 is a perspective view of a floor formed using the modular construction blocks shown in FIG. 11 and in which portions of the blocks have been removed to provide troughs for added strength.

FIGS. 11 and 12 illustrate a modified 2-hole block 400 in which top portions of the block have been removed to open and expose the horizontally-extending passageway to define and form a trough 474. When used in the floor or foundation, the removed portions are filled to the top of the blocks with concrete (and reinforcing bar) to strengthen the floor along a horizontal plane compared to the floor shown in FIG. 5. The increased strength may allow a floor to have a greater span between supports, columns, or bearing walls. While the modified 2-hole block may include removal of two portions, specific portions may be selected and removed, for example, on site. For example, FIG. 13 illustrates a floor 500 which includes alternating portions of the 2-hole blocks having portions removed. It will be appreciated that where added strength is needed, the two-hole blocks may be formed with troughs by a manufacturer, cut prior to assembly, or cut after assembly, and then filled with concrete and reinforcing bars.

Figure 14:
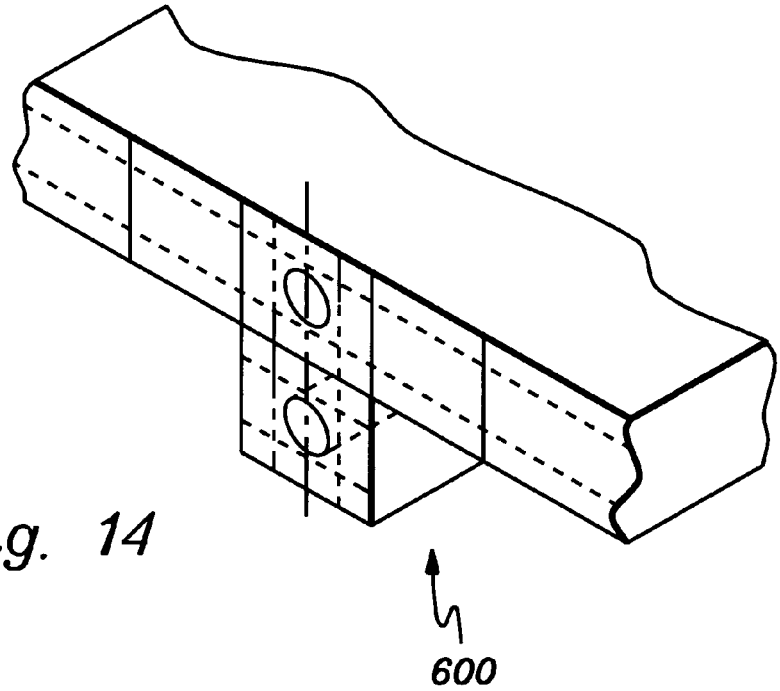
FIG. 14 is a perspective view of floor having an I-bean formed in accordance with the present invention.

In addition, an I-beam may be formed into a floor using blocks of the present invention. As shown in FIG. 14, a floor I-beam 600 may be formed by two stacked rows of 5-hole blocks. The block disposed below the floor may be provided with plugs on each of the lateral sides and bottom. Such a configuration may result in floors with greater spans or reduced need for support columns.

The footings, girders, and headers, I-beams being formed with the 5-hole blocks provide a grid, a lattice, or a criss-crossing and interconnecting pattern (e.g., ladder on side) resulting in added strength. In addition, footings formed with the 5-hole blocks have a grid in one plane which is connected the floor disposed in a second plane. Use of the modular construction blocks of the present invention results added strength to the structure in that the entire structure may be formed with a concrete and steel reinforced locked-in web or cage due to the grid formations resulting form assembly of the various blocks. In addition, the intersection of, for example, a wall to a floor, or a wall to a roof may be provided with two rows of 5-hole blocks to provide a grid in one or more planes.

The walls, floors, foundations, footings, and roofs may be covered with a suitable covering material such as plaster, stucco or other suitable material. Sheetrock may be glued to the inside of walls and floors may be glued in place. Radiant heat may be bonded to the floor before securing a finished floor above.

Figure 15:
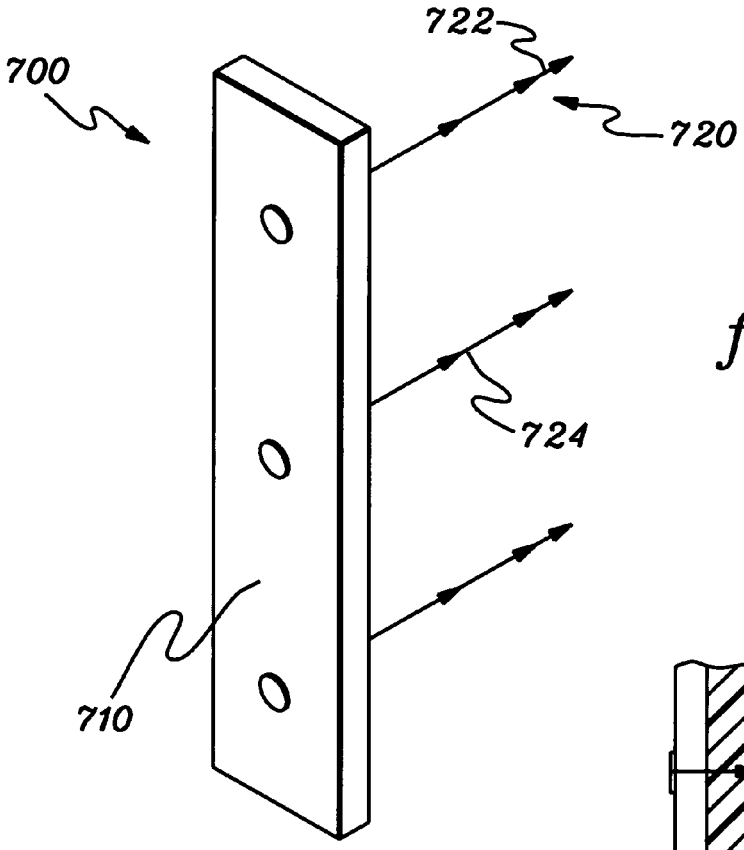
FIG. 15 is a perspective view of a furring strip in accordance with the present invention.
Figure 16:
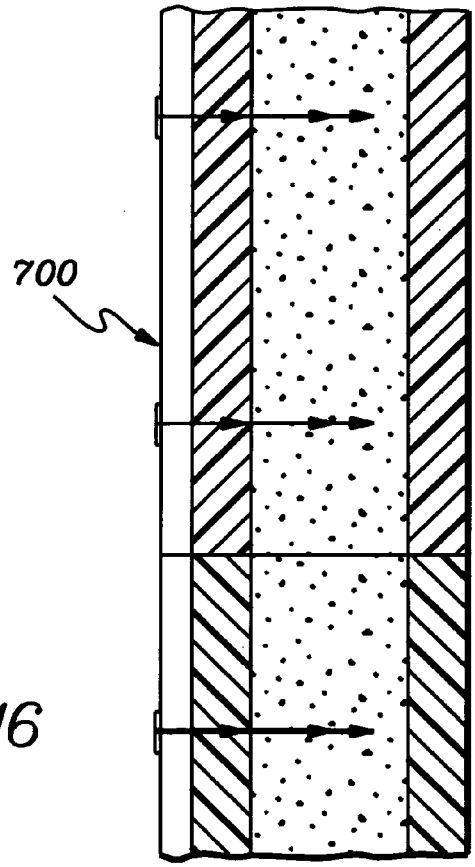
FIG. 16 is a sectional view of a wall formed from modular construction blocks to which the furring strips of FIG. 15 is attached.

FIG. 15 illustrates a surface fastener or furring strip 700 for use in attaching other types of interior or exterior surfacing to the assembled blocks. Furring strip 700 generally includes an elongated member 710 and a plurality of anchors 720. Prior to introducing concrete into the various passageways in, for example a wall as shown in FIG. 16, a plurality of spaced-apart furring strips 700 may be positioned against the wall with the anchors pushed through the foam blocks. An end portion 722 of the anchors 720 may have outwardly extending portions such as spikes or barbs which attach and anchor to the concrete when cured, while the middle portion 724 may have outwardly extending portions such as spikes or barbs which engage and are retained in the foam portion of a block prior to the concrete being poured. Various finishing surfaces such as wood framing can be attached to the elongated member 710. The elongated member may be made from wood or plastic and may be sized three inches wide and 1¼ inches thick.

Such structures formed in accordance with the invention may be better able to withstand winds, tornados, or other natural forces. In addition, a structure such as a building may be formed or manufactured at a central or manufacturing site, and due to its grid-like interconnection of the concrete and reinforced bars, may be lifted and transported to a remote site for use. While the entire structure may be assembled and transported, smaller sections or portions may also be assembled and transported with final assembly at a desired location. For transporting, one or more attachment points such as attachment hooks or eyes may be incorporated into the structure to allow the structure to be lifted and transported. In addition, the building structure may be configured and include suitable devices to allow the structure to be buoyant, and thus, float in a body of water such as a lake or river. It will also be appreciated by those skilled in the art that various sizes of the blocks may be used. For example, for a shed, six inch blocks having three inch diameter passageways may be used.

Thus, while various embodiments of the present invention have been illustrated and described, it will be appreciated to those skilled in the art that many changes and modifications may be made thereunto without departing from the spirit and scope of the invention.

The invention claimed is:

1. A modular construction block comprising:

a preform having a top surface, a bottom surface, opposite side surfaces, and opposite end surfaces; and said preform having;

a first horizontal passageway extending between said opposite end surfaces, said first horizontal passageway defining openings on said opposite end surfaces spaced from said top surface, said bottom surface and said opposite side surfaces;

a pair of spaced-apart vertical passageways extending from said top surface to said bottom surface and intersecting said first horizontal passageway, said pair of spaced-apart vertical passageways defining openings on said top surface and said bottom surface spaced from said opposite side surfaces and said opposite end surfaces;

a pair of spaced-apart second horizontal passageways extending between said opposite side surfaces and intersecting said first horizontal passageway and said pair of vertical passageways, said pair of spaced-apart second horizontal passageways defining openings on said opposite side surfaces spaced from said top surface, said bottom surface, and said opposite end surfaces; and wherein said preform comprises a foam material.

2. The modular construction block of claim 1 wherein cross-sections of the passageways are the same.

3. The modular construction block of claim 1 wherein at least one of said top surface and said bottom surface, said opposite side surfaces, and said opposite end surfaces comprise interlocking portions for engaging adjacent modular construction blocks.

4. The modular construction block of claim 1 wherein said preform comprises a plastic foam material.

5. A building structure comprising:

a plurality of modular construction blocks of claim 1.

6. The building structure of claim 5 wherein the modular blocks are assembled and filled with concrete to form a reinforced grid pattern in at least two planes.

7. The building structure of claim 5 wherein the modular blocks are assembled and filled with concrete to form a reinforced grid pattern in three planes.

8. A kit for forming a building structure comprising:

a first plurality of modular construction blocks of claim 1; and a second plurality of modular construction blocks comprising a preform having a top surface, a bottom surface, opposite side surfaces, opposite end surfaces, and a pair of spaced-apart passageways extending between said opposite side surfaces.

9. The kit of claim 8 further comprising a plurality of plugs for sealing openings formed by said passageways.

10. The kit of claim 8 further comprising a plurality of furring strips comprising an elongated member and a plurality of anchors.

11. The kit of claim 8 wherein cross-sections of the passageways are the same.

12. A method for forming a floor comprising:

providing a first plurality of modular construction blocks of claim 1;

providing a second plurality of modular construction blocks comprising a preform having a top surface, a bottom surface, opposite side surfaces, opposite end surfaces, and a pair of spaced-apart horizontal passageways extending between the opposite side surfaces;

assembling at least one row of the first plurality of modular construction blocks within the second plurality of modular construction blocks to define a girder; and introducing concrete into the passageways in the first and second plurality of modular construction blocks so that the concrete in the first plurality of modular construction blocks forms the girder.

13. A method for forming a footing and a foundation, the method comprising:

assembling a first plurality of modular construction blocks of claim 1 end to end to form a perimeter of the foundation;

assembling a second plurality of modular construction blocks within the footing to form the foundation, the second modular construction blocks comprising a preform having a top surface, a bottom surface, opposite side surfaces, opposite end surfaces, and a pair of spaced-apart horizontal passageways extending between the opposite side surfaces; and introducing concrete into the passageways in the first and second plurality of modular construction blocks so that the concrete in the perimeter forms a grid pattern.

14. The method of claim 13 further comprising assembling at least one row of the first plurality of modular construction blocks within the foundation to form a girder.

15. The method of claim 13 further comprising inserting a plurality of plugs in the openings of the plurality of blocks.

16. The modular construction block of claim 1 wherein said preform comprises a length of about 24 inches, a height of about 12 inches, and a width of about 12 inches.

17. A modular construction block comprising:

a preform having a top, a bottom, opposite sides, and opposite ends;

at least three intersecting passageways extending through said preform;

said at least three intersecting passageways extending along three different planes;

a first of said at least three intersecting passageways defining openings on said opposite ends spaced from said top, said bottom, and said opposite sides;

a second of said at least three intersecting passageways defining an opening on said top spaced from said opposite sides and said opposite ends;

a third of said at least three intersecting passageways defining openings on said opposite sides spaced from said top, said bottom, and said opposite ends; and wherein said preform comprises a foam material.

18. The modular construction block of claim 17 wherein at least one of said top surface and said bottom surface, said opposite side surfaces, and said opposite end surfaces comprise interlocking portions for engaging adjacent modular construction blocks.

19. The modular construction block of claim 17 wherein said preform comprises a plastic foam material.

20. A building structure comprising:

a plurality of modular construction blocks of claim 17.

21. The building structure of claim 20 wherein the modular blocks are assembled and filled with concrete to form a reinforced grid pattern in at least two planes.

22. The building structure of claim 20 wherein the modular blocks are assembled and filled with concrete to form a reinforced grid pattern in three planes.

23. A kit for forming a building structure comprising:

a first plurality of modular construction blocks of claim 17; and a second plurality of modular construction blocks comprising a preform having a top surface, a bottom surface, opposite side surfaces, opposite end surfaces, and a pair of spaced-apart passageways extending between said opposite side surfaces.

24. The kit of claim 23 further comprising a plurality of plugs for sealing openings formed by said passageways.

25. The kit of claim 23 further comprising a plurality of furring strips comprising an elongated member and a plurality of anchors.

26. The kit of claim 23 wherein cross-sections of the passageways are the same.

27. A method for forming a floor comprising:

providing a first plurality of modular construction blocks of claim 17;

providing a second plurality of modular construction blocks comprising a preform having a top surface, a bottom surface, opposite side surfaces, opposite end surfaces, and a pair of spaced-apart horizontal passageways extending between the opposite side surfaces;

assembling at least one row of the first plurality of modular construction blocks within the second plurality of modular construction blocks to define a girder; and introducing concrete into the passageways in the first and second plurality of modular construction blocks so that the concrete in the first plurality of modular construction blocks forms the girder.

28. A method for forming a footing and a foundation, the method comprising:

assembling a first plurality of modular construction blocks of claim 17 end to end to form a perimeter of the foundation;

assembling a plurality of second modular construction blocks within the footing to form the foundation, the second modular construction blocks comprising a preform having a top surface, a bottom surface, opposite side surfaces, opposite end surfaces, and a pair of spaced-apart horizontal passageways extending between the opposite side surfaces; and introducing concrete into the passageways in the first and second plurality of modular construction blocks so that the concrete in the perimeter forms a grid pattern.

29. The method of claim 28 further comprising assembling at least one row of the first plurality of modular construction blocks within the foundation to define a girder.

30. The method of claim 29 further comprising inserting a plurality of plugs in the openings of the plurality of blocks.

31. A method for forming a wall, the method comprising:

assembling a plurality of modular construction blocks of claim 17;

installing a plurality of furring strips against the assembled blocks, the plurality of furring strips comprising an elongated member, and a plurality of elongated anchors attachable to the elongated member and having an elongated portion extendable through said modular construction blocks and into said passageways, said elongated portion having at least one outwardly-extending portion for engaging the modular construction block and at least one outwardly extending portion extending into the passageways, and wherein the at least one outwardly-extending portions comprise barbs; and introducing concrete into the passageways of the assembled plurality of modular construction blocks so a portion of the plurality of anchors is secured in the concrete.

32. The modular construction block of claim 17 wherein said preform comprises a length of about 24 inches, a height of about 12 inches, and a width of about 12 inches.

33. A kit for forming a building structure comprising:

a first plurality of modular construction blocks comprising a preform having a top surface, a bottom surface, opposite side surfaces, and opposite end surfaces; and said preform having;

a first horizontal passageway extending between said opposite end surfaces, said first horizontal passageway defining openings on said opposite end surfaces spaced from said top surface, said bottom surface, and said opposite side surfaces;

a pair of spaced-apart vertical passageways extending from said top surface and intersecting said first horizontal passageway, said pair of spaced-apart vertical passageways defining openings on said top surface spaced from said opposite side surfaces and said opposite end surfaces; and a pair of spaced-apart second horizontal passageways extending between said opposite side surfaces and intersecting said first horizontal passageway and said pair of vertical passageway, said pair of spaced-apart second horizontal passageways defining openings on said opposite side surfaces spaced from said top surface, said bottom surface, and said opposite end surfaces;

a second plurality of modular construction blocks comprising a preform having a top surface, a bottom surface, opposite side surfaces, opposite end surfaces, and a pair of spaced-apart passageways extending between said opposite side surfaces; and a plurality of plugs for sealing openings formed by said passageways.

34. A kit for forming a building structure comprising:

a first plurality of modular construction blocks comprising a preform having a top surface, a bottom surface, opposite side surfaces, and opposite end surfaces; and said preform having;

a first horizontal passageway extending between said opposite end surfaces, said first horizontal passageway defining openings on said opposite end surfaces spaced from said top surface, said bottom surface and said opposite side surfaces;

a pair of spaced-apart vertical passageways extending from said top surface and intersecting said first horizontal passageway, said pair of spaced-apart vertical passageways defining openings on said top surface spaced from said opposite side surfaces and said opposite end surfaces; and a pair of spaced-apart second horizontal passageways extending between said opposite side surfaces and intersecting said first horizontal passageway and said pair of vertical passageway, said pair of spaced-apart second horizontal passageways defining openings on said opposite side surfaces spaced from said top surface, said bottom surface, and said opposite end surfaces;

a second plurality of modular construction blocks comprising a preform having a top surface, a bottom surface, opposite side surfaces, opposite end surfaces, and a pair of spaced-apart passageways extending between said opposite side surfaces; and a plurality of furring strips comprising an elongated member and a plurality of anchors comprising barbs.

35. A kit for forming a building structure comprising:

a first plurality of modular construction blocks comprising:

a preform having a top, a bottom, opposite sides, and opposite ends;

at least three intersecting passageways extending through said preform;

wherein said at least three intersecting passageways extend along three different planes;

a first of said at least three intersecting passageways defining openings on said opposite ends spaced from said top, said bottom and said opposite sides;

a second of said at least three intersecting passageways defining an opening on said top spaced from said opposite sides and said opposite ends; and a third of said at least three intersecting passageways defining openings on said opposite sides spaced from said top, said bottom, and said opposite ends;

a second plurality of modular construction blocks comprising a preform having a top surface, a bottom surface, opposite side surfaces, opposite end surfaces, and a pair of spaced-apart passageways extending between said opposite side surfaces; and a plurality of plugs for sealing openings formed by said passageways.

36. A kit for forming a building structure comprising:

a first plurality of modular construction blocks comprising:

a preform having a top, a bottom, opposite sides, and opposite ends;

at least three intersecting passageways extending through said preform;

wherein said at least three intersecting passageways extend along three different planes;

a first of said at least three intersecting passageways defining openings on said opposite ends spaced from said top, said bottom and said opposite sides;

a second of said at least three intersecting passageways defining an opening on said top spaced from said opposite sides and said opposite ends; and a third of said at least three intersecting passageways defining openings on said opposite sides spaced from said top, said bottom, and said opposite ends;

a second plurality of modular construction blocks comprising a preform having a top surface, a bottom surface, opposite side surfaces, opposite end surfaces, and a pair of spaced-apart passageways extending between said opposite side surfaces; and a plurality of furring strips comprising an elongated member and a plurality of anchors comprising barbs.

37. A method for forming a floor comprising:

providing a first plurality of modular construction blocks comprising a preform comprising a foam material and having a top surface, a bottom surface, opposite side surfaces, and opposite end surfaces; and said preform having;

a first horizontal passageway extending between said opposite end surfaces, said first horizontal passageway defining openings on said opposite end surfaces spaced from said top surface, said bottom surface and said opposite side surfaces;

a pair of spaced-apart vertical passageways extending from said top surface and intersecting said first horizontal passageway, said pair of spaced-apart vertical passageways defining openings on said top surface spaced from said opposite side surfaces and said opposite end surfaces; and a pair of spaced-apart second horizontal passageways extending between said opposite side surfaces and intersecting said first horizontal passageway and said pair of vertical passageways, said pair of spaced-apart second horizontal passageways defining openings on said opposite side surfaces spaced from said top surface, said bottom surface, and said opposite end surfaces;

providing a second plurality of modular construction blocks comprising a preform comprising a foam material and having a top surface, a bottom surface, opposite side surfaces, opposite end surfaces, and a pair of spaced-apart horizontal passageways extending between the opposite side surfaces;

assembling at least one row of the first plurality of modular construction blocks in the second plurality of modular construction blocks to define a girder; and introducing concrete into the passageways in the first and second plurality of modular construction blocks so that the concrete in the first plurality of modular construction blocks forms the girder.

38. A method for forming a floor comprising:

providing a first plurality of modular construction blocks comprising:

a preform comprising a foam material and having a top, a bottom, opposite sides, and opposite ends;

at least three intersecting passageways extending through said preform;

wherein said at least three intersecting passageways extend along three different planes;

a first of said at least three intersecting passageways defining openings on said opposite ends spaced from said top, said bottom and said opposite sides;

a second of said at least three intersecting passageways defining an opening on said top spaced from said opposite sides and said opposite ends; and a third of said at least three intersecting passageways defining openings on said opposite sides spaced from said top, said bottom, and said opposite ends;

providing a second plurality of modular construction blocks comprising a preform comprising a foam material and having a top surface, a bottom surface, opposite side surfaces, opposite end surfaces, and a pair of spaced-apart horizontal passageways extending between the opposite side surfaces;

assembling at least one row of the first plurality of modular construction blocks within the second plurality of modular construction blocks to define a girder; and introducing concrete into the passageways in the first and second plurality of modular construction blocks so that the concrete in the first plurality of modular construction blocks form the girder.

39. A method for forming a footing and a foundation, the method comprising:

assembling a first plurality of modular construction blocks end to end to form a perimeter of the foundation, the first plurality of blocks comprising a preform having a top surface, a bottom surface, opposite side surfaces, and opposite end surfaces; and said preform comprising a foam material and having;

a first horizontal passageway extending between said opposite end surfaces, said first horizontal passageway defining openings on said opposite end surfaces spaced from said top surface, said bottom surface and said opposite side surfaces;

a pair of spaced-apart vertical passageways extending from said top surface and intersecting said first horizontal passageway, said pair of spaced-apart vertical passageways defining openings on said top surface spaced from said opposite side surfaces and said opposite end surfaces; and a pair of spaced-apart second horizontal passageways extending between said opposite side surfaces and intersecting said first horizontal passageway and said pair of vertical passageway, said pair of spaced-apart second horizontal passageways defining openings on said opposite side surfaces spaced from said top surface, said bottom surface, and said opposite end surfaces;

assembling a second plurality of modular construction blocks within the footing to form the foundation, the second modular construction blocks comprising a preform comprising a foam material and having a top surface, a bottom surface, opposite side surfaces, opposite end surfaces, and a pair of spaced-apart horizontal passageways extending between the opposite side surfaces; and introducing concrete into the passageways in the first and second plurality of modular construction blocks so that the concrete in the perimeter forms a grid pattern.

40. A method for forming a footing and a foundation, the method comprising:

assembling a first plurality of modular construction blocks end to end to form a perimeter of the foundation, the first plurality of modular construction blocks comprising:

a preform comprising a foam material and having a top, a bottom, opposite sides, and opposite ends;

at least three intersecting passageways extending through said preform;

wherein said at least three intersecting passageways extend along three different planes;

a first of said at least three intersecting passageways defining openings on said opposite ends spaced from said top, said bottom and said opposite sides;

a second of said at least three intersecting passageways defining an openings on said top spaced from said opposite sides and said opposite ends; and a third of said at least three intersecting passageways defining openings on said opposite sides spaced from said top, said bottom, and said opposite ends;

assembling a plurality of second modular construction blocks within the footing to form the foundation, the second modular construction blocks comprising a preform comprising a foam material and having a top surface, a bottom surface, opposite side surfaces, opposite end surfaces, and a pair of spaced-apart horizontal passageways extending between the opposite side surfaces; and introducing concrete into the passageways in the first and second plurality of modular construction blocks so that the concrete in the perimeter forms a grid pattern.

41. A method for forming a building structure, the method comprising:

providing a plurality of preforms comprising a foam material and having a top, a bottom, opposite sides, and opposite ends, and at least three intersecting passageways extending through said perform, a first of said at least three intersecting passageways defining openings on said opposite ends spaced from said top, said bottom and said opposite sides, a second of said at least three intersecting passageways defining an opening on said top spaced from said opposite sides and said opposite ends, and a third of said at least three intersecting passageways defining openings on said opposite sides spaced from said top, said bottom, and said opposite ends;

assembling the plurality of preforms into three different planes; and introducing concrete into the passageways of the plurality of preforms to form a grid pattern along three different planes.

42. The method of claim 41 wherein said plurality of preforms comprise portions of a wall, portions of a floor, and portions of a roof.

43. The method of claim 41 wherein said plurality of preforms comprise portions of a first wall, portions of a second wall, and portions of a floor.

* * * * *